US010204537B2

(12) United States Patent
Yang et al.

(10) Patent No.: US 10,204,537 B2
(45) Date of Patent: Feb. 12, 2019

(54) DISPLAY DRIVING METHOD AND DEVICE AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Kai Yang, Beijing (CN); Xiurong Wang, Beijing (CN); Xue Dong, Beijing (CN); Chenru Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 55 days.

(21) Appl. No.: 15/036,247

(22) PCT Filed: Nov. 11, 2015

(86) PCT No.: PCT/CN2015/094268
§ 371 (c)(1),
(2) Date: May 12, 2016

(87) PCT Pub. No.: WO2016/179984
PCT Pub. Date: Nov. 17, 2016

(65) Prior Publication Data

US 2017/0103690 A1 Apr. 13, 2017

(30) Foreign Application Priority Data

May 12, 2015 (CN) ..... 2015 1 0239785

(51) Int. Cl.
*G09G 3/20* (2006.01)
*G09F 9/30* (2006.01)
(Continued)

(52) U.S. Cl.
CPC ..... *G09G 3/2003* (2013.01); *G09F 9/30* (2013.01); *G09G 3/2074* (2013.01); *G09G 5/003* (2013.01);
(Continued)

(58) Field of Classification Search
CPC .... G09G 3/2003; G09G 3/2074; G09G 5/003; G09G 5/02; G09G 5/10;
(Continued)

(56) References Cited

U.S. PATENT DOCUMENTS 6,198,467 B1 3/2001 Chiang
8,594,466 B2 11/2013 Tsuda et al.
(Continued)

FOREIGN PATENT DOCUMENTS

CN 102209984 A 10/2011
CN 103886809 A 6/2014
(Continued)

OTHER PUBLICATIONS

International Search Report of PCT/CN2015/094268 in Chinese, dated Jan. 26, 2016 with English translation.
(Continued)

*Primary Examiner* — Mark Regn
(74) *Attorney, Agent, or Firm* — Collard & Roe, P.C.

(57) ABSTRACT

A display driving method and device and a display device are disclosed. The method includes: receiving an image signal to be displayed; converting the image signal to be displayed into a virtual pixel array formed by virtual sub-pixels of three colors, and determining the gray scale of each virtual sub-pixel; dividing three successive sub-pixels in a
(Continued)

row direction into a pixel unit, and arranging a sampling area at a corresponding position of each pixel unit in the virtual pixel array; and determining the gray scale of the sub-pixel of each color in the pixel unit according to the gray scale of the virtual sub-pixel of each color covered by the sampling area.

20 Claims, 12 Drawing Sheets

(51) Int. Cl.
*G09G 5/00* (2006.01)
*G09G 5/10* (2006.01)
*G09G 5/02* (2006.01)

(52) U.S. Cl.
CPC ..... *G09G 5/02* (2013.01); *G09G 5/10* (2013.01); *G09G 2300/0452* (2013.01); *G09G 2300/0469* (2013.01); *G09G 2340/0457* (2013.01)

(58) Field of Classification Search
CPC ... G09G 2300/0452; G09G 2300/0469; G09G 2340/0457; G09F 9/30
USPC ..... 345/694
See application file for complete search history.

(56) References Cited

U.S. PATENT DOCUMENTS

2006/0158466 A1 7/2006 Chien et al.
2013/0106891 A1* 5/2013 Matsueda ..... G09G 3/2003 345/589
2013/0241946 A1 9/2013 Jeong et al.
2016/0027359 A1* 1/2016 Guo ..... G09G 3/2003 345/694

FOREIGN PATENT DOCUMENTS

CN 104461441 A 3/2015
CN 104599626 A 5/2015
CN 104794998 A 7/2015

OTHER PUBLICATIONS

Notice of Transmittal of the International Search Report of PCT/CN2015/094268 in Chinese, dated Jan. 26, 2016.
Written Opinion of the International Searching Authority of PCT/CN2015/094268 in Chinese, dated Jan. 26, 2016 with English translation.
Chinese Office Action in Chinese Application No. 201510239785.2, dated Nov. 26, 2015.

* cited by examiner

| | A1 | A2 | A3 | A4 | A5 | A6 | A7 | A8 | A9 | A10 | A11 | A12 |
|---|---|---|---|---|---|---|---|---|---|---|---|---|
| C1 | R11' | G11' | B11' | R12' | G12' | B12' | R13' | G13' | B13' | R14' | G14' | B14' |
| C2 | R21' | G21' | B21' | R22' | G22' | B22' | R23' | G23' | B23' | R24' | G24' | B24' |
| C3 | R31' | G31' | B31' | R32' | G32' | B32' | R33' | G33' | B33' | R34' | G34' | B34' |
| C4 | R41' | G41' | B41' | R42' | G42' | B42' | R43' | G43' | B43' | R44' | G44' | B44' |
| C5 | R51' | G51' | B51' | R52' | G52' | B52' | R53' | G53' | B53' | R54' | G54' | B54' |
| C6 | R61' | G61' | B61' | R62' | G62' | B62' | R63' | G63' | B63' | R64' | G64' | B64' |

53

| | A1 | A2 | A3 | A4 | A5 | A6 | A7 | A8 | A9 | A10 | A11 | A12 |
|---|---|---|---|---|---|---|---|---|---|---|---|---|
| C1 | R11' | G11' | B11' | R12' | G12' | B12' | R13' | G13' | B13' | R14' | G14' | B14' |
| C2 | R21' | G21' | B21' | R22' | G22' | B22' | R23' | G23' | B23' | R24' | G24' | B24' |
| C3 | R31' | G31' | B31' | R32' | G32' | B32' | R33' | G33' | B33' | R34' | G34' | B34' |
| C4 | R41' | G41' | B41' | R42' | G42' | B42' | R43' | G43' | B43' | R44' | G44' | B44' |
| C5 | R51' | G51' | B51' | R52' | G52' | B52' | R53' | G53' | B53' | R54' | G54' | B54' |
| C6 | R61' | G61' | B61' | R62' | G62' | B62' | R63' | G63' | B63' | R64' | G64' | B64' |

55

| | A1 | A2 | A3 | A4 | A5 | A6 | A7 | A8 | A9 | A10 | A11 | A12 |
|---|---|---|---|---|---|---|---|---|---|---|---|---|
| C1 | R11' | G11' | B11' | R12' | G12' | B12' | R13' | G13' | B13' | R14' | G14' | B14' |
| C2 | R21' | G21' | B21' | R22' | G22' | B22' | R23' | G23' | B23' | R24' | G24' | B24' |
| C3 | R31' | G31' | B31' | R32' | G32' | B32' | R33' | G33' | B33' | R34' | G34' | B34' |
| C4 | R41' | G41' | B41' | R42' | G42' | B42' | R43' | G43' | B43' | R44' | G44' | B44' |
| C5 | R51' | G51' | B51' | R52' | G52' | B52' | R53' | G53' | B53' | R54' | G54' | B54' |
| C6 | R61' | G61' | B61' | R62' | G62' | B62' | R63' | G63' | B63' | R64' | G64' | B64' |

FIG. 13

| | A1 | A2 | A3 | A4 | A5 | A6 | A7 | A8 | A9 | A10 | A11 | A12 |
|---|---|---|---|---|---|---|---|---|---|---|---|---|
| C1 | B11' | R11' | G11' | B12' | R12' | G12' | B13' | R13' | G13' | B14' | R14' | G14' |
| C2 | B21' | R21' | G21' | B22' | R22' | G22' | B23' | R23' | G23' | B24' | R24' | G24' |
| C3 | B31' | R31' | G31' | B32' | R32' | G32' | B33' | R33' | G33' | B34' | R34' | G34' |
| C4 | B41' | R41' | G41' | B42' | R42' | G42' | B43' | R43' | G43' | B44' | R44' | G44' |
| C5 | B51' | R51' | G51' | B52' | R52' | G52' | B53' | R53' | G53' | B54' | R54' | G54' |
| C6 | B61' | R61' | G61' | B62' | R62' | G62' | B63' | R63' | G63' | B64' | R64' | G64' |

DISPLAY DRIVING METHOD AND DEVICE AND DISPLAY DEVICE

CROSS REFERENCE TO RELATED APPLICATIONS

This application is the National Stage of PCT/CN2015/094268 filed on Nov. 11, 2015, which claims priority under 35 U.S.C. § 119 of Chinese Application No. 201510239785.2 filed on May 12, 2015, the disclosure of which is incorporated by reference.

TECHNICAL FIELD

Embodiments of the present disclosure relate to display driving method and device and a display device.

BACKGROUND

Currently, displays are widely applied in various electronic devices, e.g., mobile phones, personal digital assistants (PDAs), digital cameras, computer screens or notebook computer screens. High-resolution displays have gradually become one important feature of various electronic devices.

A common pixel design of the conventional display involves that three sub-pixels, namely red, green and blue (RGB) sub-pixels, are adopted to form a pixel, and subsequently, a plurality of pixels are arranged in a matrix. In viewing the display device, the visual resolution of users is the physical resolution (actual resolution) of the display device. Therefore, in order to improve the display effect of the display device, a design for increasing the sampling rate (the sampling rate is quantized by pixels per inch (PPI)) of images must be adopted in the process of manufacturing the display device, namely the PPI must be improved. However, along with the increased experience requirement of the users on the display screen, the sampling rate of the image becomes higher and higher and the area of the sub-pixel becomes smaller and smaller. Currently, the manufacturing process of the sub-pixels has approached a limit. Therefore, how to improve the display effect of the display device in the case of unchanged sub-pixel area is the problem to be solved by those skilled in the technical field.

SUMMARY

Embodiments of the present disclosure provide display driving method and device and a display device, which are used for improving the display effect of the display device in the case of unchanged sub-pixel area.

For the above issues, the embodiments of the present disclosure provide the following technical schemes.

A first aspect provides a display driving method, for driving a display device which includes: a pixel array formed by sub-pixels of three colors, in which an odd row of the pixel array includes sub-pixels of a first color, sub-pixels of a second color and sub-pixels of a third color which are arranged circularly and sequentially; an even row of the pixel array includes sub-pixels of the third color, sub-pixels of the first color and sub-pixels of the second color which are arranged circularly and sequentially; the sub-pixels in the even row and the sub-pixels in the odd row are misaligned, and the misaligned distance is the horizontal width of half a sub-pixel, wherein the method comprises: receiving an image signal to be displayed; converting the image signal to be displayed into a virtual pixel array formed by virtual sub-pixels of three colors, and determining a gray scale of each virtual sub-pixel, in which each row of the virtual pixel array includes sub-pixels of the first color, sub-pixels of the second color and sub-pixels of the third color which are arranged circularly; the virtual sub-pixels in each row of the virtual pixel array have a same arrangement sequence; each column of the virtual pixel array includes sub-pixels of a same color; and the sub-pixels in a same column are aligned in a column direction; dividing three successive sub-pixels in a row direction into a pixel unit, and arranging a sampling area at a corresponding position of each pixel unit in the virtual pixel array; and determining a gray scale of the sub-pixel of each color in the pixel unit according to the gray scale of the virtual sub-pixel of each color covered by the sampling area.

For example, operation of determining a gray scale of the sub-pixel of each color in the pixel unit according to the gray scale of the virtual sub-pixel of each color covered by the sampling area includes: acquiring an arithmetic product of the gray scale and a weight factor of each virtual sub-pixel covered by the sampling area, in which the weight factor of the virtual sub-pixel is determined by a distance from a position of the virtual sub-pixel to a corresponding position of the sub-pixel in the sampling area; and acquiring the gray scale of the sub-pixel of each color in the pixel unit according to the arithmetic product of the gray scale and the weight factor of the virtual sub-pixel of each color.

For example, a height of the virtual sub-pixel is equal to a height of the sub-pixel, and a width of the virtual sub-pixel is half a width of the sub-pixel; and an area of the sampling area is equal to an area of the pixel unit.

For example, operation of dividing the three successive sub-pixels in the row direction into a pixel unit, and arranging the sampling area at the corresponding position of each pixel unit in the virtual pixel array includes: in a case where the arrangement sequence of the virtual sub-pixels in the row direction is the same as the arrangement sequence of the sub-pixels in the odd row of the pixel array and the first sub-pixel in the first pixel unit of the even row is the second sub-pixel in the row, a left margin of the sampling area corresponding to the first pixel unit in the row is disposed at an interface of the third virtual sub-pixel and the fourth virtual sub-pixel in the virtual pixel array corresponding to the row.

For example, in a case where like-sub-pixels in adjacent columns of the pixel array are configured for displaying vertical lines of the corresponding color of these sub-pixels, the luminous brightness of the sub-pixels of the corresponding color in the columns provided with the vertical lines is a first brightness, and meanwhile, the luminous brightness of sub-pixels of other colors in the columns provided with the vertical lines is a second brightness; the like-sub-pixels refer to sub-pixels which have a same color and are all disposed in the odd row or the even row of the pixel array; and the first luminous intensity is greater than the second luminous intensity.

For example, in a case where like-sub-pixels in adjacent rows of the pixel array are configured for displaying horizontal lines of the corresponding color of these sub-pixels, the luminous brightness of the sub-pixels of corresponding color in the rows provided with the horizontal lines is a first brightness, and meanwhile, the luminous brightness of sub-pixels of other colors in the rows provided with the horizontal lines is a second brightness; the like-sub-pixels refer to sub-pixels which have a same color and are all disposed in the odd row or the even row of the pixel array; and the first luminous intensity is greater than the second luminous intensity.

A second aspect provides a display driving device, for driving a display device which includes: a pixel array formed by sub-pixels of three colors, in which an odd row of the pixel array includes sub-pixels of a first color, sub-pixels of a second color and sub-pixels of a third color which are arranged circularly and sequentially; an even row of the pixel array includes sub-pixels of the third color, sub-pixels of the first color and sub-pixels of the second color which are arranged circularly and sequentially; and the first sub-pixel in the even row is shifted by half the length of the first sub-pixel in the odd row in the row direction, wherein the device comprises: a receiving unit configured to receive an image signal to be displayed; a converting unit configured to convert the image signal to be displayed into a virtual pixel array formed by virtual sub-pixels of three colors and determine the gray scale of each virtual sub-pixel, in which each row in the virtual pixel array includes sub-pixels of the first color, sub-pixels of the second color and sub-pixels of the third color which are arranged circularly; the virtual sub-pixels in each row of the virtual pixel array have a same arrangement sequence; each column in the virtual pixel array includes sub-pixels of a same color; and the sub-pixels in a same column are aligned in a column direction; a sampling unit configured to divide three successive sub-pixels in the row direction into a pixel unit and arrange a sampling area at a corresponding position of each pixel unit in the virtual pixel array; and a processing unit configured to determine the gray scale of the sub-pixel of each color in the pixel unit according to the gray scale of the virtual sub-pixel of each color covered by the sampling area.

For example, the processing unit includes: a calculating sub-unit configured to acquire an arithmetic product of the gray scale and a weight factor of each virtual sub-pixel covered by the sampling area, in which the weight factor of the virtual sub-pixel is determined by a distance from a position of the virtual sub-pixel to a corresponding position of the sub-pixel in the sampling area; and an acquiring sub-unit configured to acquire the gray scale of the sub-pixel of each color in the pixel unit according to the arithmetic product of the gray scale and the weight factor of the virtual sub-pixel of each color.

For example, a height of the virtual sub-pixel is equal to a height of the sub-pixel, and a width of the virtual sub-pixel is half a width of the sub-pixel; and an area of the sampling area is equal to an area of the pixel unit.

For example, in a case where the arrangement sequence of the virtual sub-pixels in the row direction is the same as the arrangement sequence of the sub-pixels in the odd row of the pixel array and the first sub-pixel in the first pixel unit of the even row is the second sub-pixel in the row, the sampling unit is configured to arrange a left margin of the sampling area corresponding to the first pixel unit in a row at an interface of the third virtual sub-pixel and the fourth virtual sub-pixel in the virtual pixel array corresponding to this row.

For example, in a case where like-sub-pixels in adjacent columns of the pixel array are configured for displaying vertical lines of the corresponding color of these sub-pixels, the processing unit is configured to allow a luminous brightness of the sub-pixels of the corresponding color in the columns provided with the vertical lines to be a first brightness, and meanwhile, allow a luminous brightness of sub-pixels of other colors in the columns provided with the vertical lines to be a second brightness; the like-sub-pixels refer to sub-pixels which have a same color and are all disposed in the odd row or the even row of the pixel array; and the first luminous intensity is greater than the second luminous intensity.

For example, in a case where like-sub-pixels in adjacent rows of the pixel array are configured for displaying horizontal lines of the corresponding color of these sub-pixels, the processing unit is configured to allow a luminous brightness of the sub-pixels of corresponding color in the rows provided with the horizontal lines to be a first brightness, and meanwhile, allow a luminous brightness of sub-pixels of other colors in the rows provided with the horizontal lines to be a second brightness; the like-sub-pixels refer to sub-pixels which have a same color and are all disposed in the odd row or the even row of the pixel array; and the first luminous intensity is greater than the second luminous intensity.

A third aspect provides a display device, comprising any of the display driving devices.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

FIG. 13 is a schematic structural view of a sampling area corresponding to the pixel unit as illustrated in FIG. 12 in an embodiment of the present disclosure;

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

It should be noted that: row and column in the embodiments of the present disclosure are relative concepts; the "row" described in the embodiments refers to the horizontal direction, namely the row direction in the application; and the "column" refers to the vertical direction, namely the column direction in the application. However, because pixels are arranged in a matrix, when observed in different directions, row and column may be exchanged, and the row direction and the column direction may also be exchanged. In addition, the orientation or position relationships indicated by "left" and "right" in the embodiment are based on the accompanying drawings, are only used for illustrating the present disclosure and do not indicate or imply that the device or element must have a specific orientation and should be constructed and operated in a specific orientation, and hence cannot be construed as the limitation of the present disclosure.

An embodiment of the present disclosure provides a display driving method which is used for driving a display device. The display device includes: a pixel array formed by sub-pixels of three colors. An odd row of the pixel array includes sub-pixels of the first color, sub-pixels of the second color and sub-pixels of the third color, which are arranged circularly and sequentially; an even row of the pixel array includes sub-pixels of the third color, sub-pixels of the first color and sub-pixels of the second color, which are arranged circularly and sequentially; the sub-pixels in the even row and the sub-pixels in the odd row are misaligned or shift, and the misaligned or shift distance is the horizontal width of half a sub-pixel.

Figure 1:
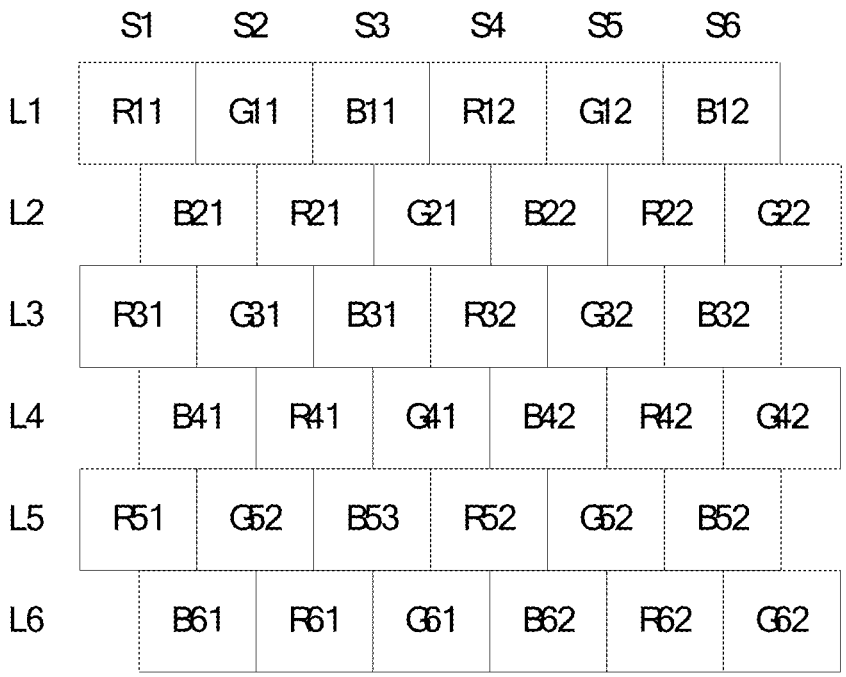
FIG. 1 is a schematic structural view of a pixel array in an embodiment of the present disclosure.

Specifically, FIG. 1 illustrates an embodiment of the present disclosure by taking the following as an example: the sub-pixel of the first color, the sub-pixel of the second color and the sub-pixel of the third color are respectively red sub-pixel, green sub-pixel and blue sub-pixel, and the pixel array includes six (6) columns (S1-S6) and six (6) rows (L1-L6) of sub-pixels. The first sub-pixel and the fourth sub-pixel in the first row (L1) of the pixel array are respectively red sub-pixels R11 and R12; the second sub-pixel and the 5th sub-pixel are respectively green sub-pixels G11 and G12; and the third sub-pixel and the 6th sub-pixel are respectively blue sub-pixels B11 and B12. The first sub-pixel and the fourth sub-pixel of the second row (L2) are respectively blue sub-pixels B21 and B22; the second sub-pixel and the 5th sub-pixel are respectively red sub-pixels R31 and R32; and the third sub-pixel and the 6th sub-pixel are respectively green sub-pixels G21 and G22. The upper sides of the first sub-pixels (B21, B41, B61) in the even rows (L2, L4, L6) are respectively shifted by half the length of the first sub-pixels (R11, R31, R51) in the odd rows (L1, L3, L5) in the row direction. Thus, an isosceles triangle is formed by connecting centers of any two adjacent sub-pixels (e.g., the first sub-pixel R11 and the second sub-pixel G11 of L1) in one row of the pixel array in the row direction and a center of a sub-pixel (e.g., the first sub-pixel B21 of L2) which is the closest to the two sub-pixels in an adjacent row of the one row and has different color with the two sub-pixels. The pixel array in which a triangle is formed by connecting centers of sub-pixels which are the closest to each other and have different colors is referred to as a delta (4 pixel array.

Figure 2:
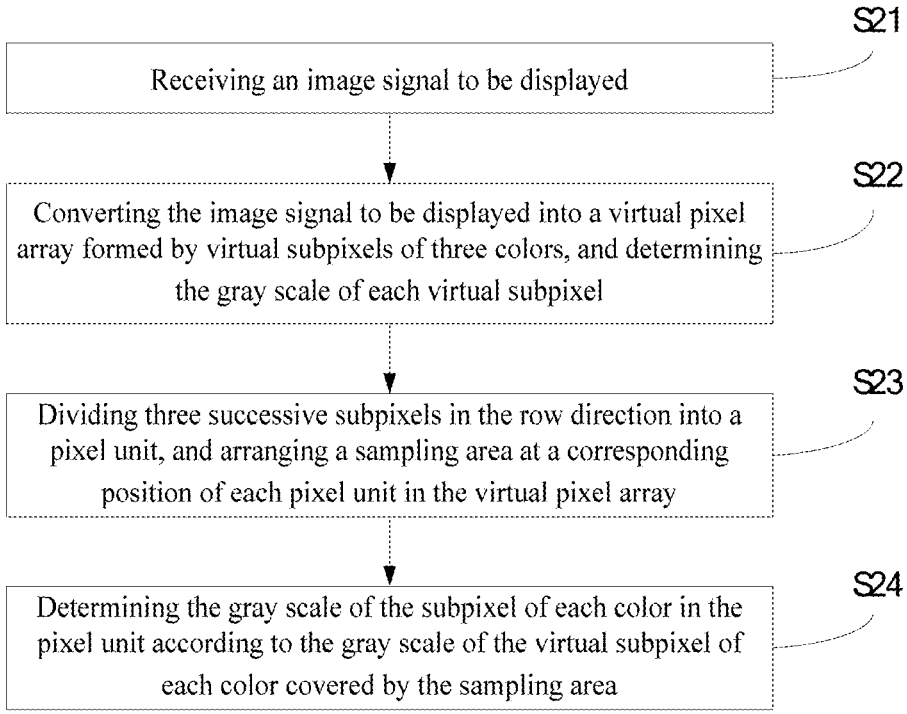
FIG. 2 is a process flowchart of a display driving method provided by an embodiment of the present disclosure.

Specifically, as illustrated in FIG. 2, the display driving method comprises the following steps:

S21: receiving an image signal to be displayed.

S22: converting the image signal to be displayed into a virtual pixel array formed by virtual sub-pixels of three colors, and determining a gray scale of each virtual sub-pixel, in which each row of the virtual pixel array includes sub-pixels of the first color, sub-pixels of the second color and sub-pixels of the third color which are arranged circularly; the virtual sub-pixels in each row of the virtual pixel array have a same arrangement sequence; each column of the virtual pixel array includes sub-pixels of a same color; and the sub-pixels in the same column are aligned in the column direction.

S23: dividing three successive sub-pixels in a row direction into a pixel unit, and arranging a sampling area at a corresponding position of each pixel unit in the virtual pixel array.

S24: determining a gray scale of the sub-pixel of each color in the pixel unit according to the gray scale of the virtual sub-pixel of each color covered by the sampling area.

It should be noted that corresponding gray scale is inputted into corresponding sub-pixel for driving display after obtaining the gray scale of the sub-pixel of each color in the pixel unit.

In the display driving method provided by the embodiment of the present disclosure, firstly, the image signal to be displayed is received; secondly, the image signal to be displayed is converted into the virtual pixel array formed by the virtual sub-pixels, and the gray scale of each virtual sub-pixel is determined; thirdly, the three successive sub-pixels in the row direction are divided into a pixel unit, and the sampling area is provided at the corresponding position of each pixel unit in the virtual pixel array; and finally, the gray scale of the sub-pixel of each color in the pixel unit is determined according to the gray scale of the virtual sub-pixel of each color covered by the sampling area. As the gray scale of each sub-pixel is determined by the gray scale of the virtual sub-pixel of corresponding color covered by the sampling area, in the embodiment of the present disclosure, one sub-pixel in the pixel array may be adopted to display the component gray scale of a plurality of virtual sub-pixels, namely the sub-pixel in the pixel array can be "shared" to achieve the resolution which is higher than the actual resolution in visual effect. Therefore, the embodiment of the present disclosure can improve the display effect of the display device in the case of given sub-pixel dimension.

Illustratively, in the step S24, operation of determining a gray scale of the sub-pixel of each color in the pixel unit according to the gray scale of the virtual sub-pixel of each color covered by the sampling area for example specifically includes:

S241: acquiring an arithmetic product of the gray scale and a weight factor of each virtual sub-pixel covered by the sampling area, in which the weight factor of the virtual sub-pixel is determined by the distance from the virtual sub-pixel in the sampling area to a corresponding position of the sub-pixel.

S242: acquiring the gray scale of the sub-pixel of each color in the pixel unit according to the arithmetic product of the gray scale and the weight factor of the virtual sub-pixel of each color.

Illustratively, a height of the virtual sub-pixel is equal to a height of the sub-pixel, and a width of the virtual sub-pixel is half a width of the sub-pixel; and an area of the sampling area is equal to an area of the pixel unit. As the height of the virtual sub-pixel is equal to that of the sub-pixel, the width of the virtual sub-pixel being half the width of the sub-pixel, the area of the sampling area being equal to the area of the pixel unit, the sampling area may include a plurality of virtual sub-pixels and the number of the virtual sub-pixels of each color is two, so that the amount of calculation in the process of determining the gray scale of the sub-pixel of each color in the pixel unit can be reduced.

Figures 3, 4:
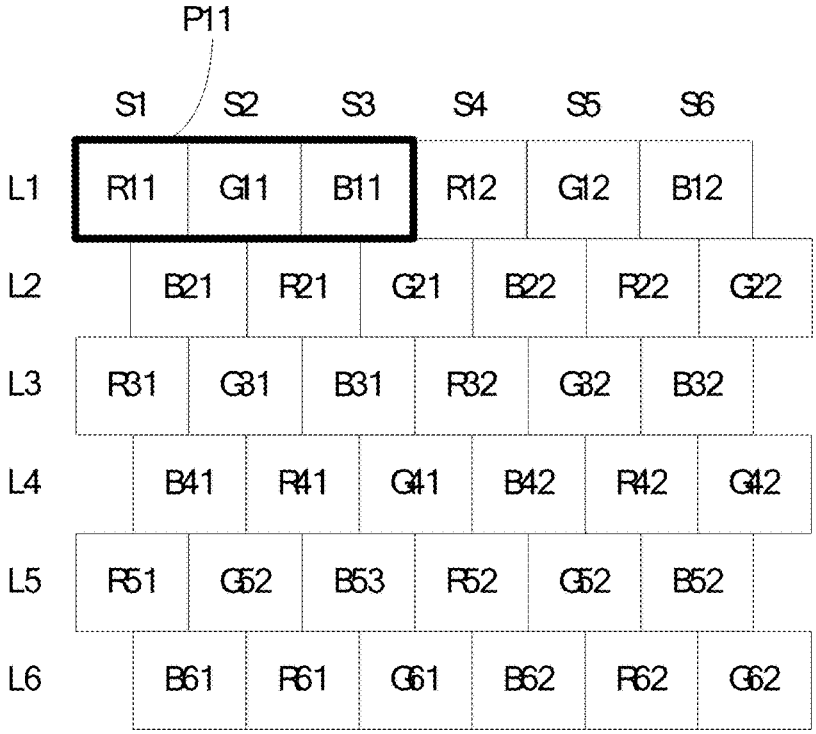
FIG. 3 is a schematic structural view of a virtual pixel array in an embodiment of the present disclosure.
FIG. 4 is a schematic diagram of an embodiment of the present disclosure, in which three successive sub-pixels in an odd row of sub-pixels in the row direction, starting from the first sub-pixel, are divided into a pixel unit.

Specifically, FIG. 3 illustrates the embodiment of the present disclosure by taking the following as an example: the image signal to be displayed is converted into a virtual pixel array including 12 columns (A1-A12) and 6 rows (C1-C6); the height of the virtual sub-pixel in the virtual pixel array is equal to the height of the sub-pixel, and the width of the virtual sub-pixel is half the width of the sub-pixel; and the area of the sampling area is equal to the area of the pixel unit. In the virtual pixel array as illustrated in FIG. 3, the same column includes sub-pixels of one color, and the arrangement sequence of the virtual sub-pixels in the same row is red virtual sub-pixel, green virtual sub-pixel and blue virtual sub-pixel.

Detailed description will be given below to the embodiment of the present disclosure by taking the following as an example: the arrangement sequence of the virtual sub-pixels in the virtual pixel array is the same as the arrangement sequence of the sub-pixels in an odd row (as illustrated in FIGS. 1 and 3), and the gray scale of the sub-pixel of each color in the pixel unit is determined in the process of dividing different pixel units.

I. Dividing Three Successive Sub-Pixels in the Row Direction, Starting from the First Sub-Pixel, into a Pixel Unit.

As illustrated in FIG. 4, because three successive sub-pixels in an odd row of sub-pixels of the pixel array in the row direction, starting from the first sub-pixel, are divided into a pixel unit, the first pixel unit P11 in L1 is a pixel unit formed by three sub-pixels R11, G11 and B11. As for other odd rows, the first pixel unit of the $n^{th}$ row is a pixel unit formed by three sub-pixels Rn1, Gn1 and Bn1, and the second pixel unit is a pixel unit formed by three sub-pixels Rn2, Gn2 and Bn2.

Figure 5:
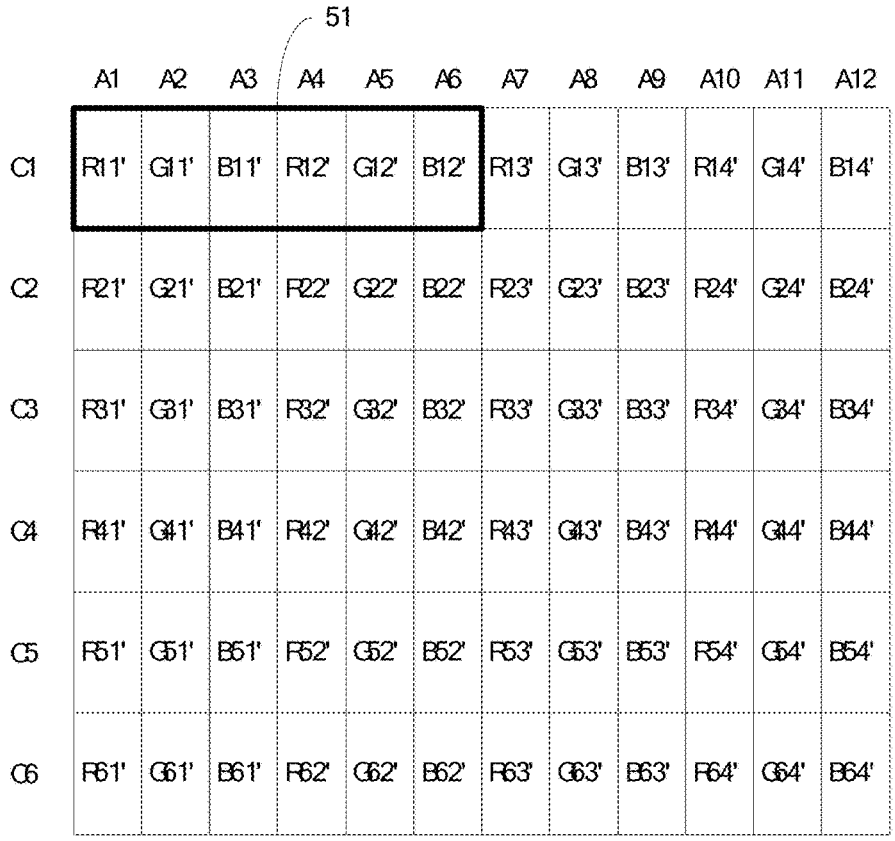
FIG. 5 is a schematic structural view of a sampling area corresponding to the pixel unit as illustrated in FIG. 4 in an embodiment of the present disclosure.

As illustrated in FIG. 5, a sampling area 51 is disposed at a corresponding position of the pixel unit P11 as illustrated in FIG. 4 in the virtual pixel array as illustrated in FIG. 5. As the height of the virtual sub-pixel in the virtual pixel array is equal to the height of the sub-pixel, the width of the virtual sub-pixel being half the width of the sub-pixel, the area of the sampling area being equal to the area of the pixel unit, the sampling area 51 of P11 is disposed in the first row C1 of the virtual pixel array as illustrated in FIG. 5 and includes 6 virtual sub-pixels which are respectively R11', G11', B11', R12', G12' and B11'. The sampling means of pixel units in other odd rows is similar to the sampling means of P11 in the first row. No further description will be given here respectively.

The sampling area of P11 covers two red virtual sub-pixels (R11' and R12'), so the gray scale of the red sub-pixel R11 in P11 is:

$$HR11=aHR11'+bHR12',$$

where HR11 refers to the gray scale of the red sub-pixel R11; HR11' refers to the gray scale of the virtual sub-pixel R11'; HR12' refers to the gray scale of the virtual sub-pixel R12'; "a" refers to the weight factor of the virtual sub-pixel R11'; and "b" refers to the weight factor of the virtual sub-pixel R12'. The values "a" and "b" are determined by a distance from a position of the virtual sub-pixel to a corresponding position of the sub-pixel in the sampling area, and a+b=1. Moreover, the corresponding position of the sub-pixel R11 in the sampling area is superimposed with the positions of the virtual sub-pixels R11' and G11', so the distance from R11' to the corresponding position of the sub-pixel R11 is short and the distance from R12' to the corresponding position of the sub-pixel R11 is long. Therefore, the weight factor "a" of the virtual sub-pixel R11' is greater than the weight factor b of the virtual sub-pixel R12', namely a>b.

The gray scale of the green sub-pixel G11 in P11 is:

$$HG11=aHG11'+bHG12',$$

where HG11 refers to the gray scale of the green sub-pixel G11 in P11; HG11' refers to the gray scale of the virtual sub-pixel G11'; HG12' refers to the gray scale of the virtual sub-pixel G12'; "a" refers to the weight factor of the virtual sub-pixel G11'; and "b" refers to the weight factor of the virtual sub-pixel G12'. The values "a" and "b" are determined by a distance from a position of the virtual sub-pixel to a corresponding position of the sub-pixel in the sampling area, and a+b=1. Moreover, the corresponding position of the sub-pixel G11 in the sampling area is superimposed with the positions of the virtual sub-pixels B11' and R12', so the distance from G11' to the corresponding position of the sub-pixel G11 is equal to the distance from G12' to the corresponding position of the sub-pixel G11. Therefore, the weight factor "a" of the virtual sub-pixel G11' is equal to the weight factor b of the virtual sub-pixel G12', namely a=b=0.5.

The gray scale of the blue sub-pixel B11 in P11 is:

$$HB11=aHB11'+bHB12',$$

where HB11 refers to the gray scale of the blue sub-pixel B11 in P11; HB11' refers to the gray scale of the virtual sub-pixel B11'; HB12' refers to the gray scale of the virtual sub-pixel B12'; "a" refers to the weight factor of the virtual sub-pixel B11'; and "b" refers to the weight factor of the virtual sub-pixel B12'. The values "a" and "b" are determined by a distance from a position of the virtual sub-pixel to a corresponding position of the sub-pixel in the sampling area, and a+b=1. Moreover, the corresponding position of the sub-pixel B11 in the sampling area is superimposed with the positions of the virtual sub-pixels G12' and B12', so the distance from the position of B11' to the corresponding position of the sub-pixel B11 is long and the distance from B12' to the corresponding position of the sub-pixel B11 is short. Therefore, the weight factor "a" of the virtual sub-pixel B11' is smaller than the weight factor b of the virtual sub-pixel B12', namely a<b.

Figure 6:
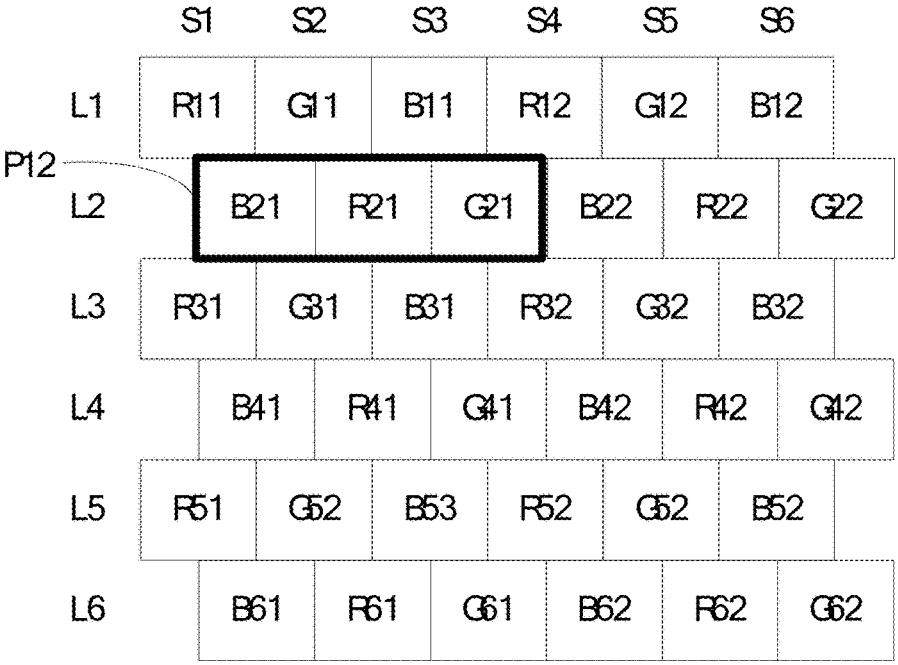
FIG. 6 is a schematic diagram of the embodiment of the present disclosure, in which three successive sub-pixels in an even row of sub-pixels in the row direction, starting from the first sub-pixel, are divided into a pixel unit.

Moreover, as illustrated in FIG. 6, because three successive sub-pixels in an even row of sub-pixels of the pixel array in the row direction, starting from the first sub-pixel, are divided into a pixel unit, the first pixel unit P12 in L2 is a pixel unit formed by three sub-pixels B21, R21 and G21. As for other even rows, the first pixel unit in the $n^{th}$ row is a pixel unit formed by three sub-pixels Bn1, Rn1 and Gn1, and the second pixel unit is a pixel unit formed by three sub-pixels Bn2, Rn2 and Gn2.

Figure 7:
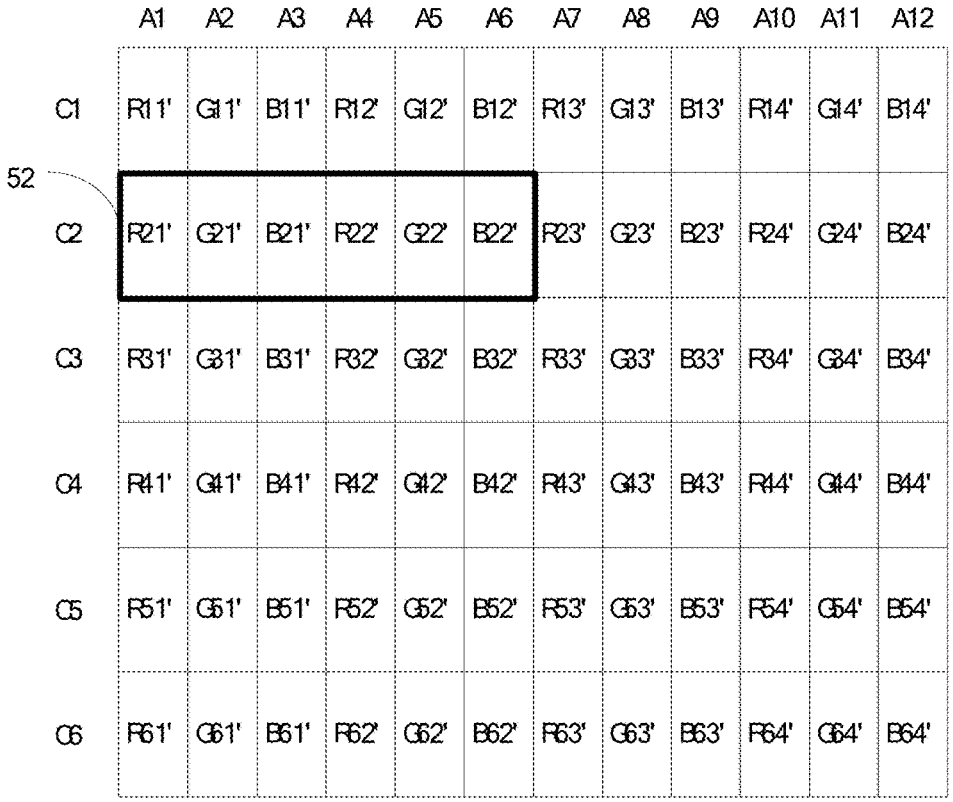
FIG. 7 is a schematic structural view of a sampling area corresponding to the pixel unit as illustrated in FIG. 6 in an embodiment of the present disclosure.

As illustrated in FIG. 7, a sampling area 52 is disposed at a corresponding position of the pixel unit P12 as illustrated in FIG. 6 in the virtual pixel array as illustrated in FIG. 7. As the height of the virtual sub-pixel in the virtual pixel array is equal to that of the sub-pixel, the width of the virtual sub-pixel being half the width of the sub-pixel, the area of the sampling area being equal to the area of the pixel unit, the sampling area 52 of P12 is disposed in the second row C2 of the virtual pixel array and includes 6 virtual sub-pixels which are respectively: R21', G21', B21', R22', G22' and B22'. The sampling means of pixel units in other even rows is similar to the sampling means of P12 in the second row. No further description will be given here one by one.

The gray scale of the sub-pixel of each color in P12 is respectively:

$$HR21=aHR21'+bHR22';$$

$$HG21=cHG21'+cHG22';$$

$$HB21=bHB21'+aHB22',$$

where HR21 refers to the gray scale of the red sub-pixel R21; HG21 refers to the gray scale of the green sub-pixel G21; HB21 refers to the gray scale of the blue sub-pixel B21; HR21', HR22', HG21', HG22', HB21' and HB22' are respectively the gray scale of the virtual sub-pixels R21', R22', G21', G22', B21' and B22'; and a, b and c are respectively the weight factor of the virtual sub-pixels, in which the values "a" and "b" are determined by the distance from the virtual sub-pixel to the corresponding position of the sub-pixel, and a+b=1, a>b, 2c=1.

II. Three Successive Sub-Pixels in the Row Direction, Starting from the Second Sub-Pixel, are Divided into a Pixel Unit.

Figure 8:
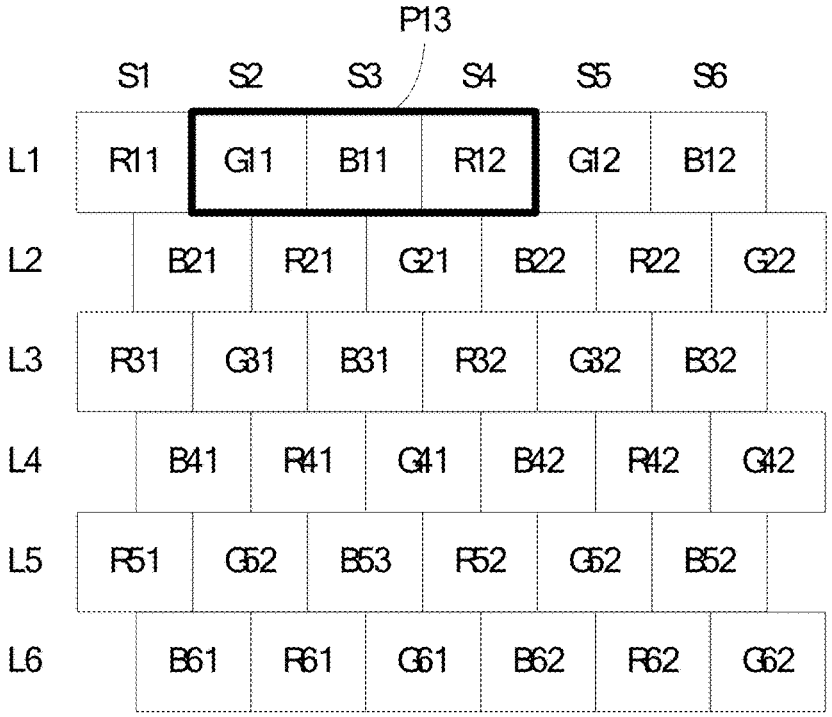
FIG. 8 is a schematic diagram of the embodiment of the present disclosure, in which three successive sub-pixels in an odd row of sub-pixels in the row direction, starting from the second sub-pixel, are divided into a pixel unit.
Figures 9, 10:
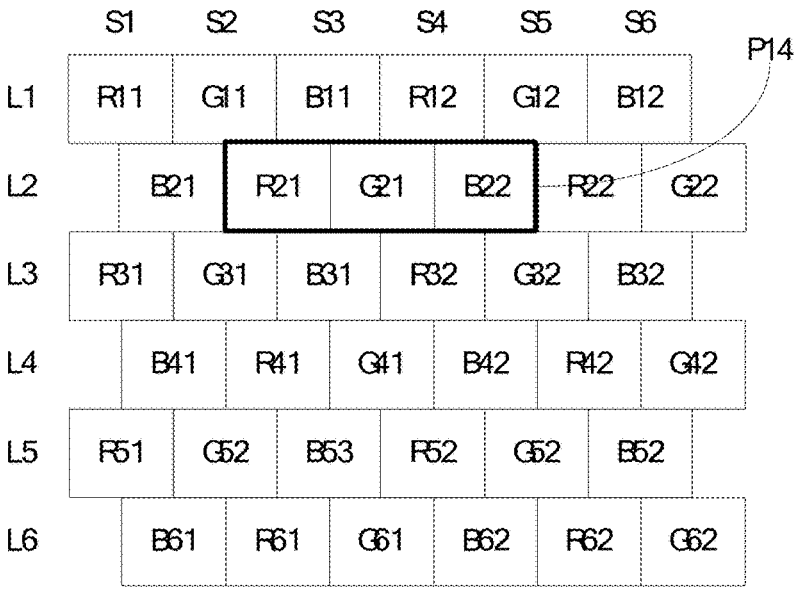
FIG. 9 is a schematic structural view of a sampling area corresponding to the pixel unit as illustrated in FIG. 8 in an embodiment of the present disclosure.
FIG. 10 is a schematic diagram of the embodiment of the present disclosure, in which three successive sub-pixels in an even row of sub-pixels in the row direction, starting from the second sub-pixel, are divided into a pixel unit.

As illustrated in FIG. 8, as three successive sub-pixels in an odd row of sub-pixels of the pixel array as illustrated in FIG. 1 in the row direction, starting from the second sub-pixel, are divided into a pixel unit, the pixel unit P13 is a pixel unit formed by three sub-pixels G11, B11 and R12, and the first sub-pixel, the first sub-pixel in last place and the second sub-pixel in last place in odd rows (L1 and L3) are disposed at the edge of the pixel array and do not belong to any pixel unit. At this point, as illustrated in FIG. 9, the sampling area of P13 in the virtual pixel array as illustrated in FIG. 9 includes: 6 virtual sub-pixels which are respectively B11', R12', G12', B12', R13' and G13'. The calculation method of the gray scale of the sub-pixel of each color in P13 is similar to the calculation method of the gray scale of the sub-pixel of each color in P11. The gray scale of the edge sub-pixel R11 is HR11=aR11'; the gray scale of B12 is HB12=aHB13'+bHB14'; and the gray scale of G12 is HG12=aHG14'. That is to say, the gray scale of the edge sub-pixel is calculated by taking the following as an example: four (4) columns of virtual sub-pixels with the gray scale of 0 are also provided before the A1 column of the virtual pixel array and two (2) columns of virtual sub-pixels with the gray scale of 0 are also provided after the A12 column of the virtual pixel array.

As for the even row, in the case where the arrangement sequence of the virtual sub-pixels in the row direction is the same as the arrangement sequence of the sub-pixels in the odd row and the first sub-pixel in the first pixel unit of the even row is the second sub-pixel in the row, the left margin of the sampling area corresponding to the first pixel unit in the row is disposed at an interface of the third virtual sub-pixel and the fourth virtual sub-pixel in the virtual pixel array corresponding to the row.

Figure 11:
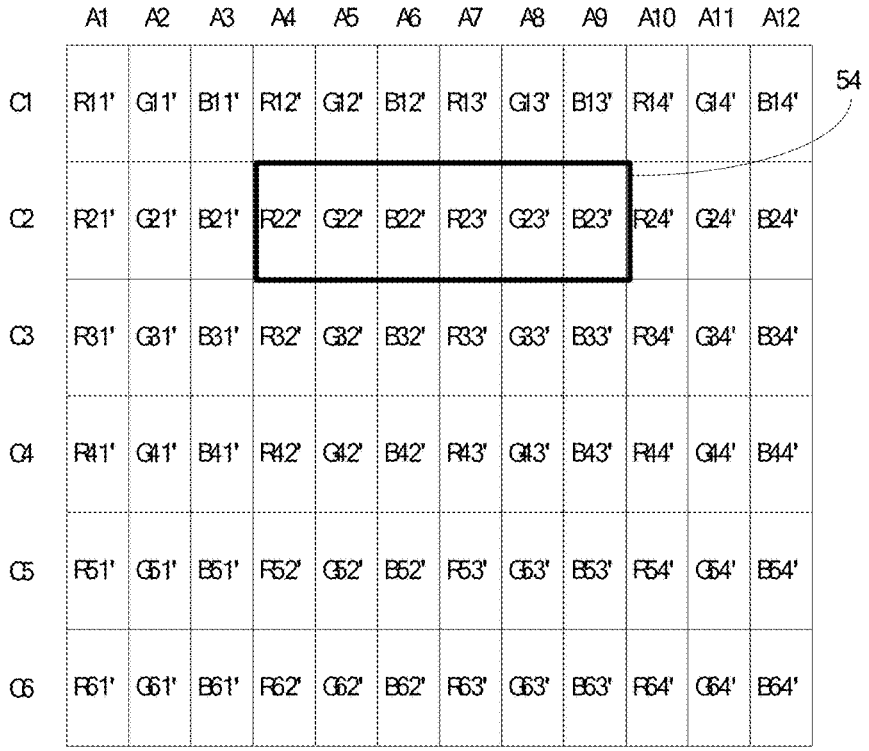
FIG. 11 is a schematic structural view of a sampling area corresponding to the pixel unit as illustrated in FIG. 10 in an embodiment of the present disclosure.

Specifically, as illustrated in FIG. 10, as three successive sub-pixels in an even row of sub-pixels of the pixel array in the row direction, starting from the second sub-pixel, are divided into a pixel unit, the pixel unit P14 is a pixel unit formed by three sub-pixels R21, G21 and B22, and the first sub-pixel, the first sub-pixel in last place and the second sub-pixel in last place in even rows (L2 and L4) are disposed at the edge of the pixel array and do not belong to any pixel unit. At this point, the left margin of the sampling area 54 corresponding to the first pixel unit P14 in the row is disposed at an interface of the third virtual sub-pixel and the fourth virtual sub-pixel in the virtual pixel array corresponding to the row. Specifically, as illustrated in FIG. 11, the left margin of the sampling area 54 of P14 in the virtual pixel array as illustrated in FIG. 11 is disposed at an interface of the third virtual sub-pixel B21' and the fourth virtual sub-pixel R22' corresponding to the row. The sampling area includes: 6 virtual sub-pixels which are respectively R22', G22', B22', R23', G23' and B23'. The calculation method of the gray scale of the sub-pixel of each color in P14 is similar to the calculation method of the gray scale of the sub-pixel of each color in P12. The gray scale of the edge sub-pixel B21 is HB21=bHB21' the gray scale of R22 is HR22=aHR24'; and the gray scale of G22 is HG22=cHG24'. That is to say, the gray scale of the edge sub-pixel is calculated by taking the following as an example: 3 columns of virtual sub-pixels with the gray scale of 0 are also provided before the A1 column of the virtual pixel array and 3 columns of virtual sub-pixels with the gray scale of 0 are also provided after the A12 column of the virtual pixel array.

III. Dividing Three Successive Sub-Pixels in the Row Direction, Starting from the Third Sub-Pixel, into a Pixel Unit.

Figure 12:
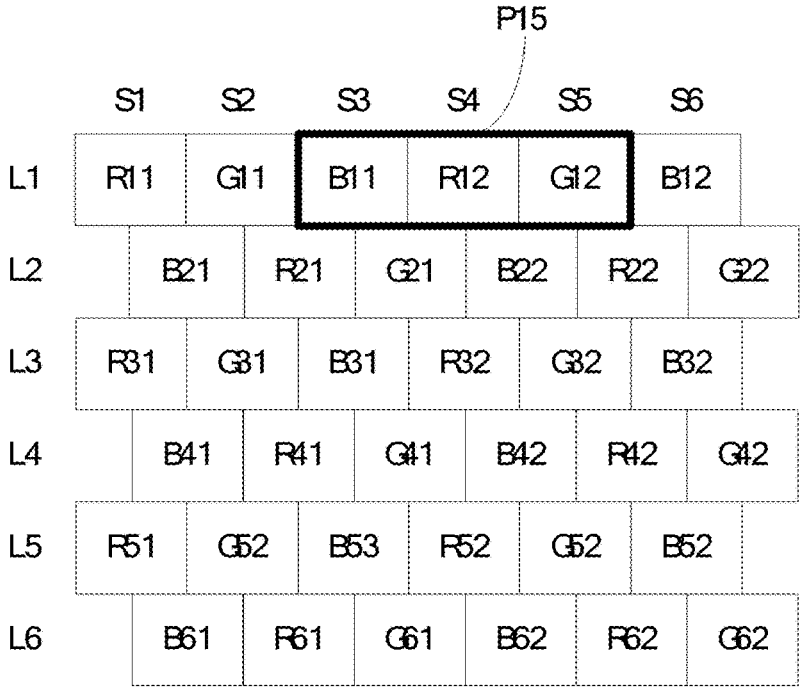
FIG. 12 is a schematic diagram of the embodiment of the present disclosure, in which three successive sub-pixels in an odd row of sub-pixels in the row direction, starting from the third sub-pixel, are divided into a pixel unit.

As illustrated in FIG. 12, as three successive sub-pixels in an odd row of sub-pixels of the pixel array in the row direction, starting from the third sub-pixel, are divided into a pixel unit, the pixel unit P15 is a pixel unit formed by three sub-pixels B11, R12 and G12, and the first sub-pixel, the second sub-pixel and the first sub-pixel in last place in odd rows (L1 and L3) are disposed at the edge of the pixel array and do not belong to any pixel unit. At this point, as illustrated in FIG. 13, the sampling area of P15 in the virtual pixel array as illustrated in FIG. 13 includes: 6 virtual sub-pixels which are respectively G12', B12', R13', G13', B13' and R14'. The calculation method of the gray scale of the sub-pixel of each color in P15 is similar to the calculation method of the gray scale of the sub-pixel of each color in P11. The gray scale of the edge sub-pixel R11 is HR11=aHR11'+bHR12'; the gray scale of G11 is HG11=cG11'; and the gray scale of B12 is HB12=aHB14'. That is to say, the gray scale of the edge sub-pixel is calculated by taking the following as an example: 2 columns of virtual sub-pixels with the gray scale of 0 are also provided before the A1 column of the virtual pixel array and 4 columns of virtual sub-pixels with the gray scale of 0 are also provided after the A12 column of the virtual pixel array.

Figure 14:
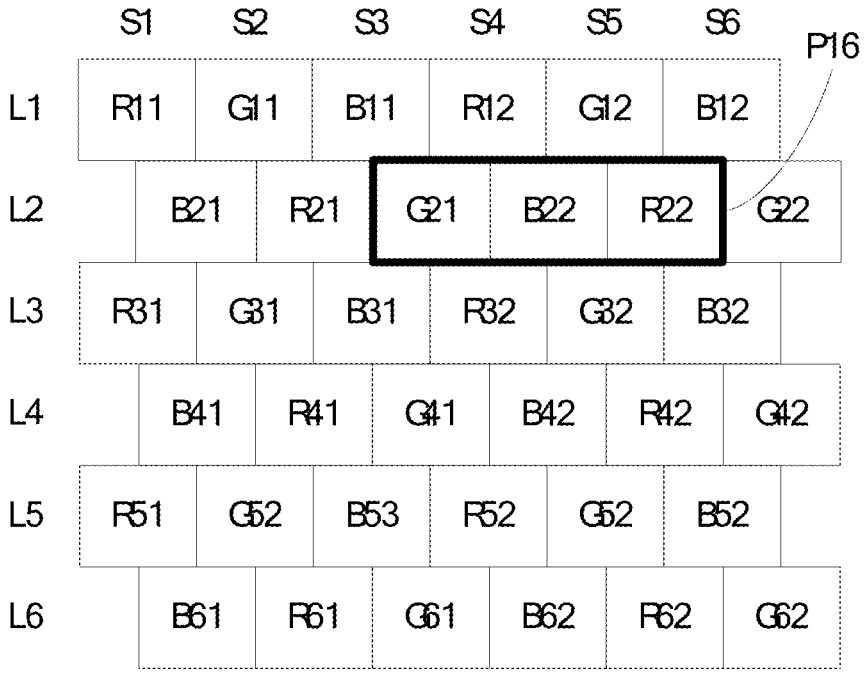
FIG. 14 is a schematic diagram of the embodiment of the present disclosure, in which three successive sub-pixels in an even row of sub-pixels in the row direction, starting from the third sub-pixel, are divided into a pixel unit.
Figure 15:
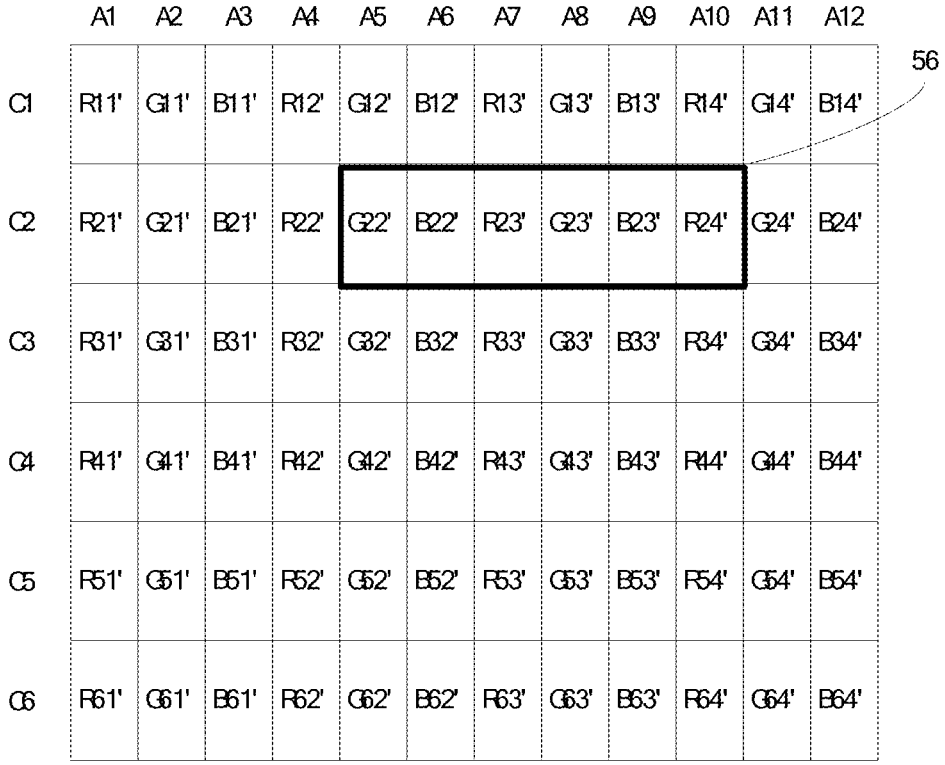
FIG. 15 is a schematic structural view of a sampling area corresponding to the pixel unit as illustrated in FIG. 14 in an embodiment of the present disclosure.

As illustrated in FIG. 14, as three successive sub-pixels in an even row of sub-pixels of the pixel array in the row direction, starting from the third sub-pixel, are divided into a pixel unit, the pixel unit P16 is a pixel unit formed by three sub-pixels G21, B22 and R22. At this point, as illustrated in FIG. 15, a sampling area 56 of P16 in the virtual pixel array as illustrated in FIG. 15 includes: 6 virtual sub-pixels G22', B22', R23', G23', B23' and R24'. The calculation method of the gray scale of the sub-pixel of each color in P16 is similar to the calculation method of the gray scale of the sub-pixel of each color in P13 and P14. The gray scale of the edge sub-pixel B21 is HB21=aHB21'; the gray scale of R21 is HR21=aHR21+bHR22'; and the gray scale of G22 is HG22=aHG24'. That is to say, the gray scale of the edge sub-pixel is calculated by taking the following as an example: 2 columns of virtual sub-pixels with the gray scale of 0 are also provided before the A1 column of the virtual pixel array and 4 columns of virtual sub-pixels with the gray scale of 0 are also provided after the A12 column of the virtual pixel array.

In addition, in the embodiment, the division of the pixel unit in the odd row of sub-pixels and the even row of the sub-pixels may adopt different division means. For instance, three successive sub-pixels in an odd row in the row direction, starting from the first sub-pixel, are divided into a pixel unit, and three successive sub-pixels in an even row in the row direction, starting from the second or third sub-pixel, are divided into a pixel unit. But the calculation method of the gray scale of the sub-pixel in the pixel unit is the same as that of the above embodiment.

Figures 16, 17:
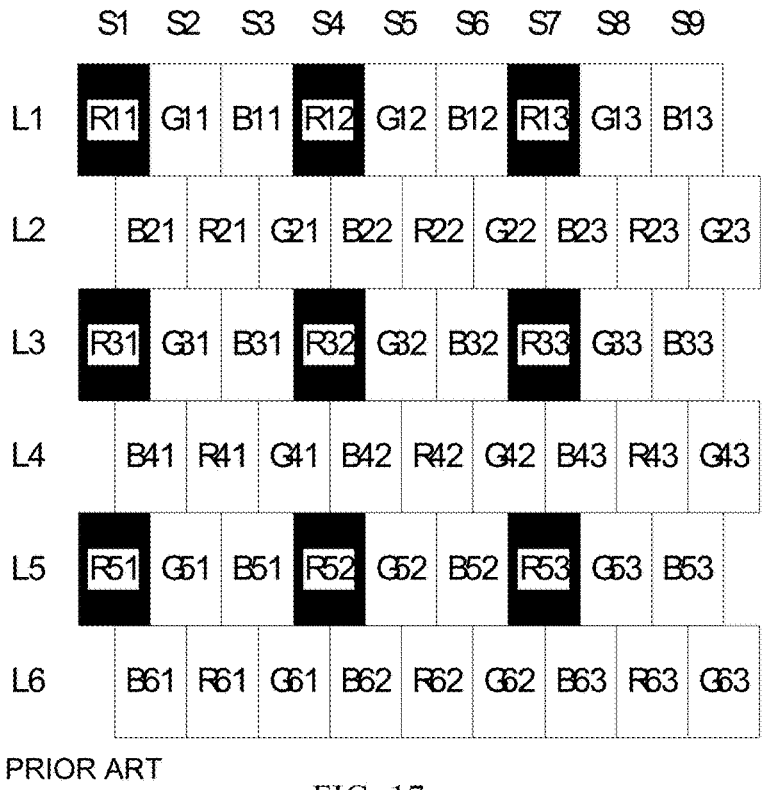
PRIOR ART FIG. 17
FIG. 16 is a schematic structural view of another virtual pixel array in an embodiment of the present disclosure.
FIG. 17 is a schematic diagram illustrating the luminescence of sub-pixels in the prior art in which similar red sub-pixels in adjacent columns are configured for displaying red vertical lines.

Of course, the image signal to be displayed may also be converted into a virtual sub-pixel array with other arrangement sequence. For instance, the arrangement sequence of virtual sub-pixels in the same row is blue virtual sub-pixel, red virtual sub-pixel and green virtual sub-pixel in sequence, or the arrangement sequence of virtual sub-pixels in the same row is blue virtual sub-pixel, green virtual sub-pixel and red virtual sub-pixel in sequence. Illustratively, as illustrated in FIG. 16, the virtual sub-pixels in the virtual pixel array and the sub-pixels in the even row have a same arrangement sequence. At this point, in the odd row of sub-pixels and the even row of sub-pixels of the pixel array, three successive sub-pixels in the row direction, starting from the first sub-pixel, the second sub-pixel or the third sub-pixel, are divided into a pixel unit. As for the odd row, the corresponding position in the sampling area is the same as the corresponding position of P11, P13 or P15 in the sampling area in the above embodiment; the number of the virtual sub-pixels in the sampling area is also the same as the number of the virtual sub-pixels in the sampling area of P11, P13 or P15; and the difference is that the positions of the virtual sub-pixels are different. At this point, the process of determining the gray scale of the sub-pixel of each color in the pixel unit is similar to the process of determining the gray scale of the sub-pixel of each color in the above embodiment, as long as the weight factor is adjusted according to the distance from the virtual sub-pixel to the corresponding position of the sub-pixel. Similarly, as for the even row, the process of determining the gray scale of the sub-pixel of each color in the pixel unit is similar to the process of determining the gray scale of the sub-pixel of each color in the above embodiment, as long as the weight factor is adjusted according to the distance from the virtual sub-pixel to the corresponding position of the sub-pixel.

Illustratively, when like-sub-pixels in adjacent columns of the pixel array are configured for displaying vertical lines (lines along the column direction) with corresponding color of the sub-pixels, the luminous brightness of the sub-pixels of the corresponding color in the columns provided with the vertical lines is a first brightness, and meanwhile, the luminous brightness of sub-pixels of other colors in the columns provided with the vertical lines is a second brightness. The like-sub-pixels refer to sub-pixels which have a same color and are all disposed in the odd row or the even row of the pixel array. The first luminous intensity is greater than the second luminous intensity.

Description is given in FIG. 17 by taking the case that red sub-pixels in adjacent columns are configured for displaying red vertical lines as an example. In the prior art, when similar red sub-pixels in adjacent columns of the pixel array are configured for displaying red vertical lines disposed in columns S1, S4 and S7, sub-pixels R11, R31, R51, R12, R32, R52, R13, R33 and R53 will display the gray scale at the same time. However, as the distance from the sub-pixel to an adjacent like-sub-pixel in the row direction and the column direction is equal to each other, for instance, the distance from R11 to R31 is equal to the distance from R11 to R12, the grid effect can be produced, and hence users cannot distinguish whether the lines displayed by the sub-pixels R11, R31, R51, R12, R32, R52, R13, R33 and R53 are horizontal lines (lines along the row direction) or vertical lines.

Figure 18:
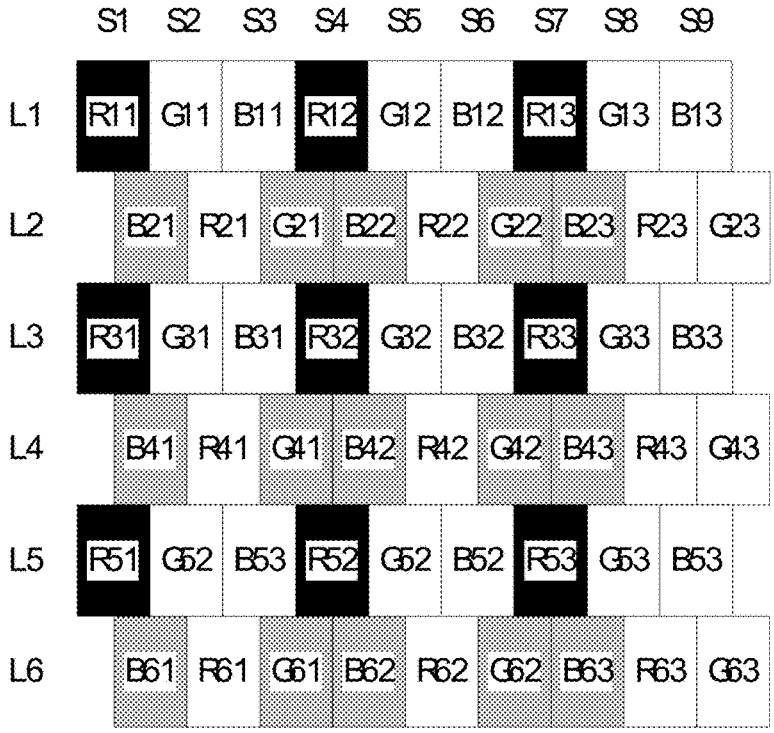
FIG. 18 is a schematic diagram illustrating the luminescence of sub-pixels in the embodiment of the present disclosure in which similar red sub-pixels in adjacent columns are configured for displaying red vertical lines.

As illustrated in FIG. 18, in the embodiment of the present disclosure, as the luminous brightness of R11, R31, R51, R12, R32, R52, R13, R33 and R53 is a first brightness and the luminous brightness of sub-pixels of other colors (B21, B41, B61, G21, B22, G41, B42, G61, B62, G22, B23, G42, B43, G62 and B63) in the columns provided with the vertical lines is a second brightness, the pixel display information at the positions of the vertical lines can be increased, and hence the case that R11, R31, R51, R12, R32, R52, R13, R33 and R53 are configured for displaying the vertical lines can be more easily determined. In addition, as the first luminous intensity is greater than the second luminous intensity, the users cannot detect the sub-pixels of other colors of which the luminous brightness is a second brightness, so the vertical lines seen by the users are still red vertical lines.

Illustratively, in the case where like-sub-pixels in adjacent columns of the pixel array are configured for displaying vertical lines of the corresponding color of these sub-pixels, the luminous brightness of the sub-pixels of the corresponding color in the columns provided with the vertical lines is a first brightness, and meanwhile, the luminous brightness of sub-pixels of other colors in the columns provided with the vertical lines is a second brightness. The like-sub-pixels refer to sub-pixels which have a same color and are all disposed in the odd row or the even row of the pixel array. The first luminous intensity is greater than the second luminous intensity.

Figure 19:
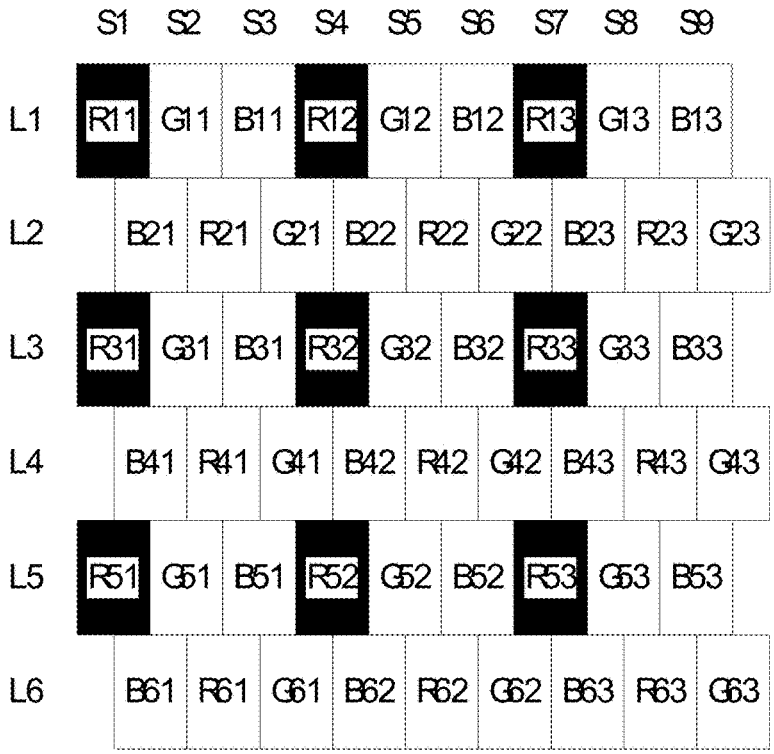
PRIOR ART FIG. 19
FIG. 19 is a schematic diagram illustrating the luminescence of sub-pixels in the prior art in which similar red sub-pixels in adjacent columns are configured for displaying red horizontal lines.

Description is given in FIG. 19 by taking the case that red sub-pixels in adjacent columns are configured for displaying red horizontal lines as an example. In the prior art, when similar red sub-pixels in adjacent columns of the pixel array are configured for displaying red horizontal lines disposed in rows L1, L3 and L5, sub-pixels R11, R12, R13, R31, R32, R33, R51, R52 and R53 will display the gray scale at the same time. However, as the distance from the sub-pixel to an adjacent like-sub-pixel in the row direction and the column direction is equal to each other, for instance, the distance from R11 to R31 is equal to the distance from R11 to R12, the grid effect can be produced, and hence the users cannot distinguish whether the lines displayed by the sub-pixels R11, R12, R13, R31, R32, R33, R51, R52 and R53 are horizontal lines or vertical lines.

Figure 20:
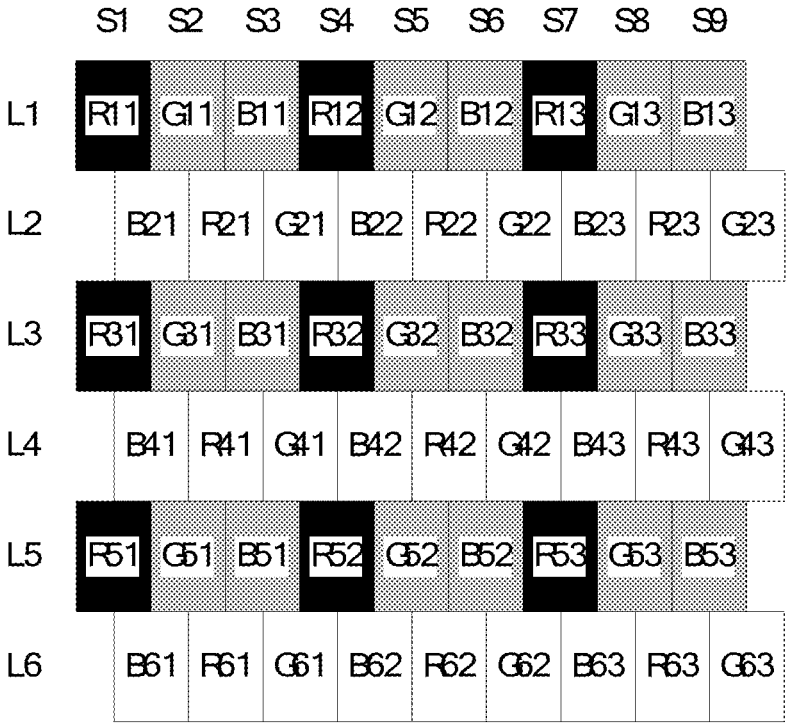
FIG. 20 is a schematic diagram illustrating the luminescence of sub-pixels in an embodiment of the present disclosure in which similar red sub-pixels in adjacent columns are configured for displaying red horizontal lines.

Similarly, as illustrated in FIG. 20, in the embodiment of the present disclosure, as the luminous brightness of R11, R12, R13, R31, R32, R33, R51, R52 and R53 is a first brightness, and meanwhile, the luminous brightness of sub-pixels of other colors (G11, B11, G12, B12, G13, B13, G31, B31, G32, B32, G33, B33, G51, B51, G52, B52, G53 and B53) in the rows provided with the horizontal lines is a second brightness, the pixel display information at the positions of the horizontal lines can be increased, and hence the case that R11, R12, R13, R31, R32, R33, R51, R52 and R53 are configured for displaying the horizontal lines can be more easily determined. In addition, as the first luminous intensity is greater than the second luminous intensity, the users cannot detect the sub-pixels of other colors of which the luminous brightness is a second brightness, so the horizontal lines seen by the users are still red horizontal lines.

Figure 21:
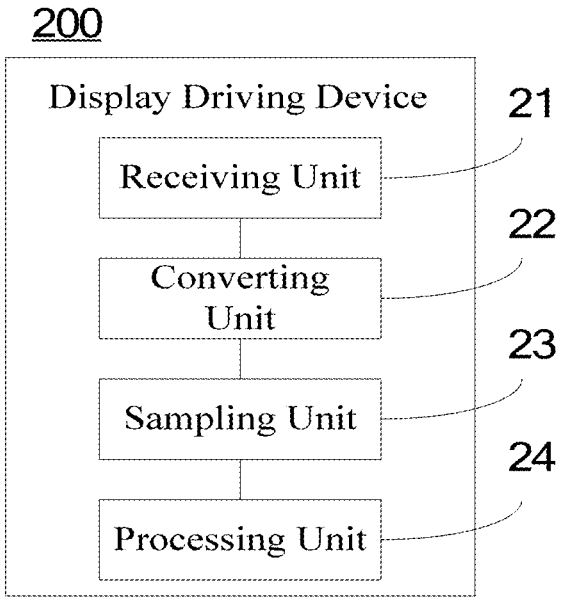
FIG. 21 is a schematic structural view of a display driving device provided by an embodiment of the present disclosure.

An embodiment of the present disclosure provides a display driving device, which is used for conducting any foregoing display driving method provided by the embodiment. The display driving device is used for driving the display device which includes: a pixel array formed by sub-pixels of three colors. An odd row of the pixel array includes sub-pixels of the first color, sub-pixels of the second color and sub-pixels of the third color which are arranged circularly and sequentially; an even row of the pixel array includes sub-pixels of the third color, sub-pixels of the first color and sub-pixels of the second color which are arranged circularly and sequentially; and the first sub-pixel in the even row is shifted by half the length of the first sub-pixel in the odd row in the row direction. Specifically, as illustrated in FIG. 21, the device 200 comprises: a receiving unit 21 configured to receive an image signal to be displayed; a converting unit 22 configured to convert the image signal to be displayed into a virtual pixel array formed by virtual sub-pixels of three colors and determine the gray scale of each virtual sub-pixel, in which each row in the virtual pixel array includes sub-pixels of the first color, sub-pixels of the second color and sub-pixels of the third color which are arranged circularly; the virtual sub-pixels in each row of the virtual pixel array have a same arrangement sequence; each column in the virtual pixel array includes sub-pixels of a same color; and the sub-pixels in a same column are aligned in a column direction; a sampling unit 23 configured to divide three successive sub-pixels in the row direction into a pixel unit and arrange a sampling area at a corresponding position of each pixel unit in the virtual pixel array; and a processing unit 24 configured to determine the gray scale of the sub-pixel of each color in the pixel unit according to the gray scale of the virtual sub-pixel of each color covered by the sampling area.

In the display driving device provided by an embodiment of the present disclosure, firstly, the receiving unit receives the image signal to be displayed; secondly, the converting unit converts the image signal to be displayed into the virtual pixel array formed by the virtual sub-pixels, and determines the gray scale of each virtual sub-pixel; thirdly, the sampling unit divides the three successive sub-pixels in the row direction into a pixel unit, and arranges the sampling area at the corresponding position of each pixel unit in the virtual pixel array; and finally, the processing unit determines the gray scale of the sub-pixel of each color in the pixel unit according to the gray scale of the virtual sub-pixel of each color covered by the sampling area. As the gray scale of each sub-pixel is determined by the gray scale of the virtual sub-pixel of corresponding color covered by the sampling area, in the embodiment of the present disclosure, one sub-pixel in the pixel array may be adopted to display the component gray scale of a plurality of virtual sub-pixels, namely the sub-pixel in the pixel array can be "shared" to achieve the resolution which is higher than the actual resolution in visual effect. Therefore, the embodiment of the present disclosure can improve the display effect of the display device in the case of given sub-pixel dimension.

Figure 22:
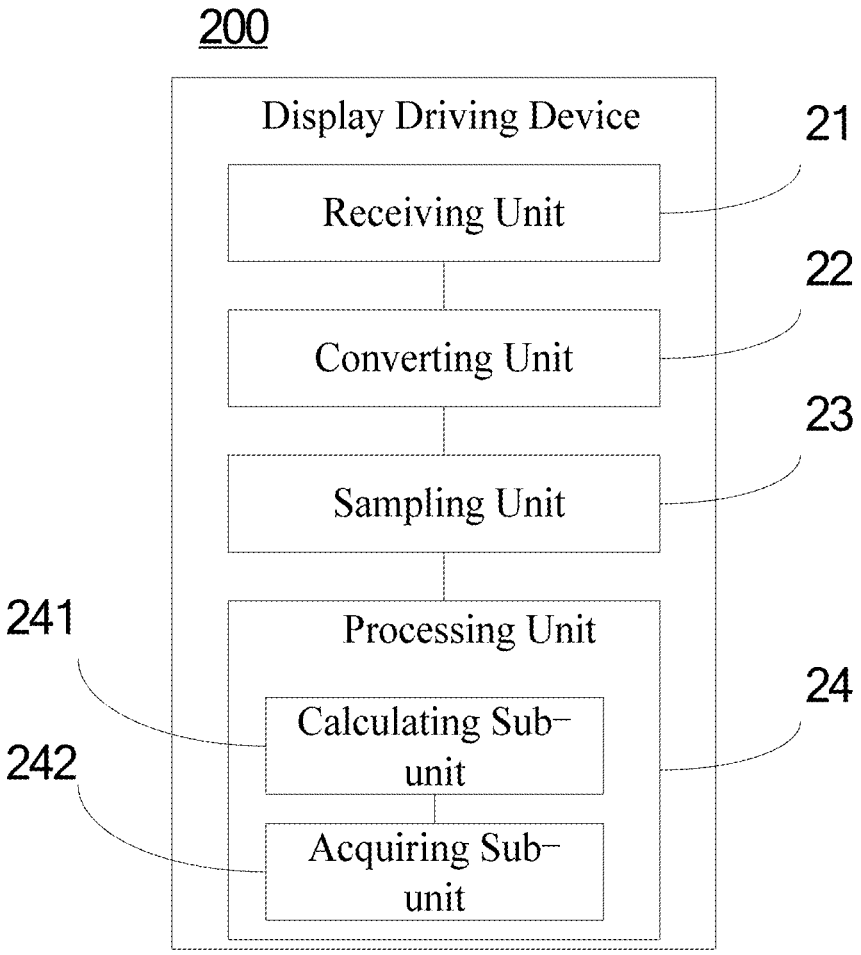
FIG. 22 is a schematic structural view of another display driving device provided by an embodiment of the present disclosure.

For instance, as illustrated in FIG. 22, the processing unit 24 includes: a calculating sub-unit 241 configured to acquire an arithmetic product of the gray scale and a weight factor of each virtual sub-pixel covered by the sampling area, in which the weight factor of the virtual sub-pixel is determined by a distance from a position of the virtual sub-pixel to a corresponding position of the sub-pixel in the sampling area; and an acquiring sub-unit 242 configured to acquire the gray scale of the sub-pixel of each color in the pixel unit according to the arithmetic product of the gray scale and the weight factor of the virtual sub-pixel of each color.

For instance, a height of the virtual sub-pixel is equal to a height of the sub-pixel, and a width of the virtual sub-pixel is half a width of the sub-pixel; and an area of the sampling area is equal to an area of the pixel unit.

For instance, in the case where the arrangement sequence of the virtual sub-pixels in the row direction is the same as the arrangement sequence of the sub-pixels in the odd row and the first sub-pixel in the first pixel unit of the even row is the second sub-pixel in the row, the sampling unit 23 is configured to arrange a left margin of the sampling area corresponding to the first pixel unit in a row at an interface of the third virtual sub-pixel and the fourth virtual sub-pixel in the virtual pixel array corresponding to this row.

For instance, in the case where like-sub-pixels in adjacent columns of the pixel array are configured for displaying vertical lines of the corresponding color of these sub-pixels, the processing unit 24 is configured to allow a luminous brightness of the sub-pixels of the corresponding color in the columns provided with the vertical lines to be a first brightness, and meanwhile, allow a luminous brightness of sub-pixels of other colors in the columns provided with the vertical lines to be a second brightness. The like-sub-pixels refer to sub-pixels which have a same color and are all disposed in the odd row or the even row of the pixel array. The first luminous intensity is greater than the second luminous intensity.

As the luminous brightness of the sub-pixels of the corresponding color in the columns provided with the vertical lines is a first brightness, and meanwhile, the luminous brightness of the sub-pixels of other colors in the columns provided with the vertical lines is a second brightness, the display information in the columns provided with the vertical lines can be increased, and hence the users can more easily determine that the displayed lines are vertical lines.

For instance, in a case where like-sub-pixels in adjacent rows of the pixel array are configured for displaying horizontal lines of the corresponding color of these sub-pixels, the processing unit 24 is configured to allow a luminous brightness of the sub-pixels of corresponding color in the rows provided with the horizontal lines to be a first brightness, and meanwhile, allow a luminous brightness of sub-pixels of other colors in the rows provided with the horizontal lines to be a second brightness. The like-sub-pixels refer to sub-pixels which have a same color and are all disposed in the odd row or the even row of the pixel array. The first luminous intensity is greater than the second luminous intensity.

As the luminous brightness of the sub-pixels of corresponding color in the rows provided with the horizontal lines is a first brightness, and meanwhile, the luminous brightness of the sub-pixels of other colors in the rows provided with the horizontal lines is a second brightness, the display information in the rows provided with the horizontal lines can be increased, and hence the users can more easily determine that the displayed lines are horizontal lines.

An embodiment of the present disclosure provides a display device, which comprises any display driving device provided by the embodiment.

In addition, the display device may be: any product or component with display function such as e-paper, a mobile phone, a tablet PC, a TV, a display, a notebook computer, a digital picture frame and a navigator.

In the display device provided by an embodiment of the present disclosure, firstly, the image signal to be displayed is received; secondly, the image signal to be displayed is converted into the virtual pixel array formed by the virtual sub-pixels, and the gray scale of each virtual sub-pixel is determined; thirdly, the three successive sub-pixels in the row direction are divided into a pixel unit, and the sampling area is provided at the corresponding position of each pixel unit in the virtual pixel array; and finally, the gray scale of the sub-pixel of each color in the pixel unit is determined according to the gray scale of the virtual sub-pixel of each color covered by the sampling area. As the gray scale of each sub-pixel is determined by the gray scale of the virtual sub-pixel of corresponding color covered by the sampling area, in the embodiment of the present disclosure, one sub-pixel in the pixel array may be adopted to display the component gray scale of a plurality of virtual sub-pixels, namely the sub-pixel in the pixel array can be "shared" to achieve the resolution which is higher than the actual resolution in visual effect. Therefore, the embodiment of the present disclosure can improve the display effect of the display device in the case of given sub-pixel dimension.

The foregoing is only the preferred embodiments of the present disclosure and not intended to limit the scope of protection of the present disclosure. The scope of protection of the present disclosure should be defined by the appended claims.

The application claims priority to the Chinese patent application No. 201510239785.2 filed May 12, 2015, the disclosure of which is incorporated herein by reference as part of the application.

What is claimed is:

1. A display driving method, for driving a display device which includes: a pixel array formed by sub-pixels of three colors, in which an odd row of the pixel array includes sub-pixels of a first color, sub-pixels of a second color and sub-pixels of a third color, which are arranged cyclically and sequentially; an even row of the pixel array includes sub-pixels of the third color, sub-pixels of the first color and sub-pixels of the second color, which are arranged cyclically and sequentially; the sub-pixels in the even row and the sub-pixels in the odd row are misaligned, and a misaligned distance is a horizontal width of half a sub-pixel, the method comprising:

receiving an image signal to be displayed;

converting the image signal to be displayed into a virtual pixel array formed by virtual sub-pixels of three colors, and determining a gray scale of each virtual sub-pixel, in which each row of the virtual pixel array includes the virtual sub-pixels of the first color, the virtual sub-pixels of the second color and the virtual sub-pixels of the third color, which are arranged cyclically; the virtual sub-pixels in each row of the virtual pixel array have a same arrangement sequence; each column of the virtual pixel array includes sub-pixels of a same color; and the sub-pixels in a same column are aligned in a column direction;

taking three successive sub-pixels in a row direction as a pixel unit, and arranging a sampling area at a corresponding position of each pixel unit in the virtual pixel array; and determining a gray scale of the sub-pixel of each color in the pixel unit according to the gray scale of the virtual sub-pixel of each color covered by the sampling area.

2. The method according to claim 1, wherein operation of determining a gray scale of the sub-pixel of each color in the pixel unit according to the gray scale of the virtual sub-pixel of each color covered by the sampling area includes:

acquiring an arithmetic product of the gray scale and a weight factor of each virtual sub-pixel covered by the sampling area, in which the weight factor of the virtual sub-pixel is determined by a distance from a position of the virtual sub-pixel to a corresponding position of the sub-pixel in the sampling area; and acquiring the gray scale of the sub-pixel of each color in the pixel unit according to the arithmetic product of the gray scale and the weight factor of the virtual sub-pixel of each color.

3. The method according to claim 2, wherein a height of the virtual sub-pixel is equal to a height of the sub-pixel, and a width of the virtual sub-pixel is half a width of the sub-pixel; and a size of the sampling area is equal to a size of the pixel unit.

4. The method according to claim 2, wherein operation of taking the three successive sub-pixels in the row direction as the pixel unit, and arranging the sampling area at the corresponding position of each pixel unit in the virtual pixel array includes:

in a case where the arrangement sequence of the virtual sub-pixels in the row direction is the same as the arrangement sequence of the sub-pixels in the odd row of the pixel array and the sub-pixel at a left margin of the even row is located outside of and adjacent to a first pixel unit of the even row, a left margin of the sampling area corresponding to the first pixel unit in the row is disposed at an interface of the third virtual sub-pixel and the fourth virtual sub-pixel in the virtual pixel array corresponding to the row.

5. The method according to claim 2, wherein in a case where like-sub-pixels in adjacent columns of the pixel array are configured for displaying vertical lines of the corresponding color of these sub-pixels, a luminous brightness of the sub-pixels of the corresponding color in the columns provided with the vertical lines is a first brightness, and meanwhile, a luminous brightness of sub-pixels of other colors in the columns provided with the vertical lines is a second brightness; the like-sub-pixels refer to sub-pixels which have a same color and are all disposed in the odd row or the even row of the pixel array; and the first luminous intensity is greater than the second luminous intensity.

6. The method according to claim 2, wherein in a case where like-sub-pixels in adjacent rows of the pixel array are configured for displaying horizontal lines of the corresponding color of these sub-pixels, a luminous brightness of the sub-pixels of corresponding color in the rows provided with the horizontal lines is a first brightness, and meanwhile, a luminous brightness of sub-pixels of other colors in the rows provided with the horizontal lines is a second brightness; the like-sub-pixels refer to sub-pixels which have a same color and are all disposed in the odd row or the even row of the pixel array; and the first luminous intensity is greater than the second luminous intensity.

7. The method according to claim 1, wherein a height of the virtual sub-pixel is equal to a height of the sub-pixel, and a width of the virtual sub-pixel is half a width of the sub-pixel; and a size of the sampling area is equal to a size of the pixel unit.

8. The method according to claim 1, wherein operation of taking the three successive sub-pixels in the row direction as the pixel unit, and arranging the sampling area at the corresponding position of each pixel unit in the virtual pixel array includes:

in a case where the arrangement sequence of the virtual sub-pixels in the row direction is the same as the arrangement sequence of the sub-pixels in the odd row of the pixel array and the sub-pixel at a left margin of the even row is located outside of and adjacent to a first pixel unit of the even row, a left margin of the sampling area corresponding to the first pixel unit in the row is disposed at an interface of the third virtual sub-pixel and the fourth virtual sub-pixel in the virtual pixel array corresponding to the row.

9. The method according to claim 1, wherein in a case where like-sub-pixels in adjacent columns of the pixel array are configured for displaying vertical lines of the corresponding color of these sub-pixels, a luminous brightness of the sub-pixels of the corresponding color in the columns provided with the vertical lines is a first brightness, and meanwhile, a luminous brightness of sub-pixels of other colors in the columns provided with the vertical lines is a second brightness; the like-sub-pixels refer to sub-pixels which have a same color and are all disposed in the odd row or the even row of the pixel array; and the first luminous intensity is greater than the second luminous intensity.

10. The method according to claim 1, wherein in a case where like-sub-pixels in adjacent rows of the pixel array are configured for displaying horizontal lines of the corresponding color of these sub-pixels, a luminous brightness of the sub-pixels of corresponding color in the rows provided with the horizontal lines is a first brightness, and meanwhile, a luminous brightness of sub-pixels of other colors in the rows provided with the horizontal lines is a second brightness; the like-sub-pixels refer to sub-pixels which have a same color and are all disposed in the odd row or the even row of the pixel array; and the first luminous intensity is greater than the second luminous intensity.

11. A display driving device, for driving a display device which includes: a pixel array formed by sub-pixels of three colors, in which an odd row of the pixel array includes sub-pixels of a first color, sub-pixels of a second color and sub-pixels of a third color, which are arranged cyclically and sequentially; an even row of the pixel array includes sub-pixels of the third color, sub-pixels of the first color and sub-pixels of the second color which are arranged cyclically and sequentially; and the first sub-pixel in the even row is shifted by half a length of the first sub-pixel in the odd row in a row direction, wherein the display device comprises:

a receiving unit configured to receive an image signal to be displayed;

a converting unit configured to convert the image signal to be displayed into a virtual pixel array formed by virtual sub-pixels of three colors and determine a gray scale of each virtual sub-pixel, in which each row in the virtual pixel array includes the virtual sub-pixels of the first color, the virtual sub-pixels of the second color and the virtual sub-pixels of the third color which are arranged cyclically; the virtual sub-pixels in each row of the virtual pixel array have a same arrangement sequence; each column in the virtual pixel array includes sub-pixels of a same color; and the sub-pixels in a same column are aligned in a column direction;

a sampling unit configured to taking three successive sub-pixels in the row direction as a pixel unit and arrange a sampling area at a corresponding position of each pixel unit in the virtual pixel array; and a processing unit configured to determine a gray scale of the sub-pixel of each color in the pixel unit according to the gray scale of the virtual sub-pixel of each color covered by the sampling area.

12. The device according to claim 11, wherein the processing unit includes:

a calculating sub-unit configured to acquire an arithmetic product of the gray scale and a weight factor of each virtual sub-pixel covered by the sampling area, in which the weight factor of the virtual sub-pixel is determined by a distance from a position of the virtual sub-pixel to a corresponding position of the sub-pixel in the sampling area; and an acquiring sub-unit configured to acquire the gray scale of the sub-pixel of each color in the pixel unit according to the arithmetic product of the gray scale and the weight factor of the virtual sub-pixel of each color.

13. The device according to claim 12, wherein in a case where the arrangement sequence of the virtual sub-pixels in the row direction is the same as the arrangement sequence of the sub-pixels in the odd row of the pixel array and the sub-pixel at a left margin of the even row is located outside of and adjacent to a first pixel unit of the even row, the sampling unit is configured to arrange a left margin of the sampling area corresponding to the first pixel unit in a row at an interface of the third virtual sub-pixel and the fourth virtual sub-pixel in the virtual pixel array corresponding to this row.

14. The device according to claim 12, wherein in a case where like-sub-pixels in adjacent columns of the pixel array are configured for displaying vertical lines of the corresponding color of these sub-pixels, the processing unit is configured to allow a luminous brightness of the sub-pixels of the corresponding color in the columns provided with the vertical lines to be a first brightness, and meanwhile, allow a luminous brightness of sub-pixels of other colors in the columns provided with the vertical lines to be a second brightness; the like-sub-pixels refer to sub-pixels which have a same color and are all disposed in the odd row or the even row of the pixel array; and the first luminous intensity is greater than the second luminous intensity.

15. The device according to claim 12, wherein in a case where like-sub-pixels in adjacent rows of the pixel array are configured for displaying horizontal lines of the corresponding color of these sub-pixels, the processing unit is configured to allow a luminous brightness of the sub-pixels of corresponding color in the rows provided with the horizontal lines to be a first brightness, and meanwhile, allow a luminous brightness of sub-pixels of other colors in the rows provided with the horizontal lines to be a second brightness; the like-sub-pixels refer to sub-pixels which have a same color and are all disposed in the odd row or the even row of the pixel array; and the first luminous intensity is greater than the second luminous intensity.

16. The device according to claim 11, wherein a height of the virtual sub-pixel is equal to a height of the sub-pixel, and a width of the virtual sub-pixel is half a width of the sub-pixel; and a size of the sampling area is equal to a size of the pixel unit.

17. The device according to claim 11, wherein in a case where the arrangement sequence of the virtual sub-pixels in the row direction is the same as the arrangement sequence of the sub-pixels in the odd row of the pixel array and the sub-pixel at a left margin of the even row is located outside of and adjacent to a first pixel unit of the even row, the sampling unit is configured to arrange a left margin of the sampling area corresponding to the first pixel unit in a row at an interface of the third virtual sub-pixel and the fourth virtual sub-pixel in the virtual pixel array corresponding to this row.

18. The device according to claim 11, wherein in a case where like-sub-pixels in adjacent columns of the pixel array are configured for displaying vertical lines of the corresponding color of these sub-pixels, the processing unit is configured to allow a luminous brightness of the sub-pixels of the corresponding color in the columns provided with the vertical lines to be a first brightness, and meanwhile, allow a luminous brightness of sub-pixels of other colors in the columns provided with the vertical lines to be a second brightness; the like-sub-pixels refer to sub-pixels which have a same color and are all disposed in the odd row or the even row of the pixel array; and the first luminous intensity is greater than the second luminous intensity.

19. The device according to claim 11, wherein in a case where like-sub-pixels in adjacent rows of the pixel array are configured for displaying horizontal lines of the corresponding color of these sub-pixels, the processing unit is configured to allow a luminous brightness of the sub-pixels of corresponding color in the rows provided with the horizontal lines to be a first brightness, and meanwhile, allow a luminous brightness of sub-pixels of other colors in the rows provided with the horizontal lines to be a second brightness; the like-sub-pixels refer to sub-pixels which have a same color and are all disposed in the odd row or the even row of the pixel array; and the first luminous intensity is greater than the second luminous intensity.

20. A display device, comprising the display driving device according to claim 11.

* * * * *